United States Patent [19]

Nawrot et al.

[11] Patent Number: 4,686,352

[45] Date of Patent: Aug. 11, 1987

[54] ELECTRONIC PRESSING IRON

[75] Inventors: Thomas L. Nawrot, Glen Ellyn; John Vancha, Bolingbrook; James C. Mysicka, Berwyn, all of Ill.

[73] Assignee: John Zink Company, Tulsa, Okla.

[21] Appl. No.: 605,442

[22] Filed: Apr. 27, 1984

[51] Int. Cl.[4] ..... H05B 1/02; D06F 75/26; G08B 21/00

[52] U.S. Cl. ..... 219/250; 38/82; 38/88; 38/90; 200/61.52; 200/61.85; 219/251; 219/257; 219/492; 219/501; 219/505; 338/22 R; 340/635; 340/686

[58] Field of Search ..... 38/82, 88, 90–92, 38/77.1–77.9, 74, 75; 219/245–259, 492, 501, 504, 505; 340/635, 686, 687; 338/22 R; 200/61.52, 61.85

[56] References Cited

U.S. PATENT DOCUMENTS

| | | | |
|---|---|---|---|
| 1,458,418 | 6/1923 | Johnston et al. | 219/250 X |
| 2,382,587 | 8/1945 | Thomas . | |
| 2,778,913 | 1/1957 | Finlayson . | |
| 2,833,903 | 5/1958 | Waddell . | |
| 2,880,531 | 4/1959 | Houck | 38/82 |
| 3,424,894 | 1/1969 | Schwartz et al. | 219/250 |
| 3,492,459 | 1/1970 | Schwartz | 219/251 |
| 3,553,429 | 1/1971 | Nelson | 219/497 |
| 3,732,394 | 5/1973 | Cusworth | 219/251 |
| 4,130,955 | 12/1978 | Baumgartner et al. | 219/257 |
| 4,203,101 | 5/1980 | Towsend | 340/635 |
| 4,240,217 | 12/1980 | Schwob | 38/77.83 |
| 4,261,120 | 4/1981 | Greco et al. | 219/248 X |
| 4,347,428 | 8/1982 | Conrad et al. | 219/251 |
| 4,398,364 | 8/1983 | Augustine et al. | 38/77.5 |
| 4,449,035 | 5/1984 | Schwob | 219/251 |
| 4,455,473 | 6/1984 | Schwob | 219/250 X |
| 4,520,257 | 5/1985 | Schwob et al. | 219/250 |

FOREIGN PATENT DOCUMENTS

| | | | |
|---|---|---|---|
| 1972914 | 11/1967 | Fed. Rep. of Germany . | |
| 2750545 | 5/1979 | Fed. Rep. of Germany . | |
| 2944242 | 5/1981 | Fed. Rep. of Germany | 219/251 |
| 59-14898 | 1/1984 | Japan | 219/251 |
| 59-14899 | 1/1984 | Japan | 219/251 |
| 82/03520 | 10/1982 | PCT Int'l Appl. | 219/251 |
| 396245 | 1/1966 | Switzerland | 219/251 |
| 1068419 | 5/1967 | United Kingdom | 219/251 |
| 2009973 | 6/1979 | United Kingdom . | |
| 2009971 | 6/1979 | United Kingdom | 219/251 |
| 2016051 | 9/1979 | United Kingdom . | |

*Primary Examiner*—Anthony Bartis
*Attorney, Agent, or Firm*—Robert J. Fox

[57] ABSTRACT

An electric pressing iron having a motion and attitude sensor including a mercury switch connected to a timer, and in conjunction therewith is adapted to disable the electric heater of the iron when the iron is oriented with the soleplate substantially horizontal and is not moving. The motion and attitude sensor and timer are also adapted to disable the electric heater when the iron is oriented with its soleplate vertical after the passage of a preselected period of time.

23 Claims, 12 Drawing Figures

ELECTRONIC PRESSING IRON

BACKGROUND OF THE INVENTION

Electric pressing irons, and in particular spray irons, steam irons, and dry irons, have been used for many years to press clothing and textiles. In prior art irons delivery of continuous steam flow or a burst of instant extra steam is provided through the soleplate to enhance the effectiveness of the pressing operation. In addition, it is well known in the prior art for pressing irons to be controlled to operate at various temperature levels so that different types of fabrics can be ironed most effectively without damaging them. It is well known that ironing efficiency varies directly with temperature so that it is desirable to iron a particular fabric at the highest temperature to which it can be subjected for a reasonable time without scorching.

A number of problems, however, still exist with household pressing irons, not the least of which are related to safety. At times a person using an iron on a piece of clothing can become distracted, stop moving the heated iron, and scorch the fabric, thereby ruining the article of clothing. Unattended irons which are left switched on are a safety hazard. Children often reach for or pick up hot unattended irons and burn themselves.

It should be appreciated, however, that the length of time for which an iron can be left unattended with its soleplate in contact with a piece of clothing or the like is considerably shorter than the amount of time an iron can be left unattended when the soleplate is in a raised position and the iron is supported on its heel rest.

Other problems encountered with prior irons are related to the accuracy of soleplate temperature control which can be achieved. Temperature stability is very important because many modern synthetic materials will be damaged at much lower temperatures than wool or cotton. It is desirable to be able to operate the iron as close as possible to the maximum temperature which such synthetics may safely withstand without damage, but which efficiently irons the synthetic material. It may be appreciated that conventional bimetallic thermostatic controls used in irons are often less than satisfactory for this purpose. The operator must set the bimetal thermostat at a considerably reduced temperature from the maximum at which the iron can be safely operated due to the fact that the soleplate temperature has a tendency to oscillate between a relatively low temperature when the iron heating element is switched on and at a relatively high temperature when the iron heating element is switched off. The temperature oscillations are sometimes described as scallops due to the scallop-shaped curve they define when graphed against time. Such oscillations typically have a magnitude of plus or minus ten degrees Centigrade, although some prior irons using bimetal thermostat controls have oscillations as small as plus or minus five degrees Centigrade.

Another problem with prior irons is that the operator of an iron is often unable to determine when the iron soleplate has reached the operating temperature for which the iron thermostat is set. It is well known for people to test crudely the temperature of the iron soleplate by lightly and quickly touching it with a finger or dropping droplets of water onto the soleplate to determine how rapidly they vaporize. This, of course, is only practical when dry ironing is done due to the fact that the soleplate temperature is often lower when steam ironing. Particularly at the lower temperatures at which synthetic fabrics are commonly ironed, it is often difficult to tell whether or not the soleplate has reached ironing temperature.

Another problem often faced by users of prior art steam irons and in particular steam irons with an instant extra steam feature of the type disclosed in U.S. Pat. No. 4,398,364 to Augustine et al. for STEAM IRON is that when the iron is being operated with the soleplate at a relatively low temperature in order to iron certain synthetic fabrics, the normal large temperature swings in the soleplate caused by the use of a bimetal thermostat control often will allow the soleplate to drop below the steaming temperature of the iron, thereby inhibiting steam generation. The problem is made worse if, at the moment the user of the iron actuates the instant extra steam feature causing an additional charge of water to enter the steaming or flash chamber, the soleplate happens to be at the bottom of one of its temperature swings, because relatively small amounts of steam will be emitted from the steam vents in the soleplate and volumes of water will be ejected rather than having all the water completely converted to steam as intended. This situation produces a condition typically known as spitting.

What is needed, then, is a pressing iron which interrupts electric current to its electric heating element when the soleplate is resting on a surface and the iron is not moving for a period of time. The iron should also have the ability to interrupt electric power to its own heating element when it has been left in the heel rest position for a longer period of time. The iron should have accurate temperature control to permit efficient ironing of synthetics and should provide an external indication to the operator as to when the soleplate is operating at the preselected ironing temperature and when the soleplate is being heated to reach the preselected ironing temperature.

SUMMARY OF THE INVENTION

An electronic pressing iron having a motion and attitude sensor and a closed loop electronic temperature control is herein disclosed. The electronic pressing iron comprises a metal soleplate adapted to be placed in contact with a fabric to be pressed. An electric resistance heating element is formed in the soleplate and when energized by an external source of alternating electric current, supplies heat thereto. A plastic housing having a handle, a heel rest and a plurality of controls is mounted on the soleplate.

An electronic control circuit has a portion mounted within the handle of the housing and a portion mounted within the heel rest to isolate the electronic components from the large quantities of heat generated in the soleplate. The handle contains motion sensing circuitry and temperature sensing circuitry while the heel rest contains power control circuitry for the heating element.

The electronic control circuit generates a regulated voltage which is fed to a voltage divider to provide a precision temperature reference signal to a window comparator. The window comparator controls an indicator light emitting diode mounted in the handle of the iron. An error signal generated by the temperature sensing circuitry and a temperature comparator controls a silicon controlled rectifier operatively coupled to an electromechanical power relay.

A mercury switch, employed both as an attitude sensor and as a motion sensor is also positioned within the handle of the electronic pressing iron so that as the iron is moved when the soleplate is in the lowered position, mercury moving in the switch makes and breaks a circuit which indirectly charges a timing capacitor. When the iron is not moving with the soleplate down, the mercury switch is closed, discharging the timing capacitor within 30 seconds, disabling the temperature control circuit and the silicon controlled rectifier and causing the power control relay to open, interrupting heating power to the electric heating element.

When the electronic pressing iron is resting on its heel rest, the mercury switch remains open preventing charging current from being supplied to the timing capacitor. A bleeder resistor connected in parallel with the timing capacitor, discharges the timing capacitor in about 10 minutes, disabling the temperature control circuit, switching off the silicon controlled rectifier and causing the relay to open, thereby interrupting power to the electric heating element.

A principal object of the present invention is to provide an electronic pressing iron having compact and reliable means for interrupting a flow of electric current to the heating element when the iron is resting on its soleplate or its side and not moving.

Another object of the instant invention is to provide an electronic pressing iron having a compact means for detecting an attitude of said pressing iron and interrupting a flow of electric power to an electric heating element when said pressing iron is in the heel rest position with its soleplate pressing surface oriented in a substantially vertical plane for a predetermined length of time.

It is another object of the instant invention to provide an electronic pressing iron having a closed loop temperature control which is highly accurate and rapidly responsive in order to provide efficient ironing of sensitive synthetic fabrics.

It is a still further object of the present invention to provide an electronic pressing iron having means for providing a visual indication of the temperature of the soleplate so that the user of the iron will know when the soleplate is operating within a predetermined temperature range.

Other objects and uses of the present invention will become obvious to one skilled in the art upon a perusal of the following specification and claims in light of the accompanying drawings.

DESCRIPTION OF THE PREFERRED EMBODIMENT

Figure 1:
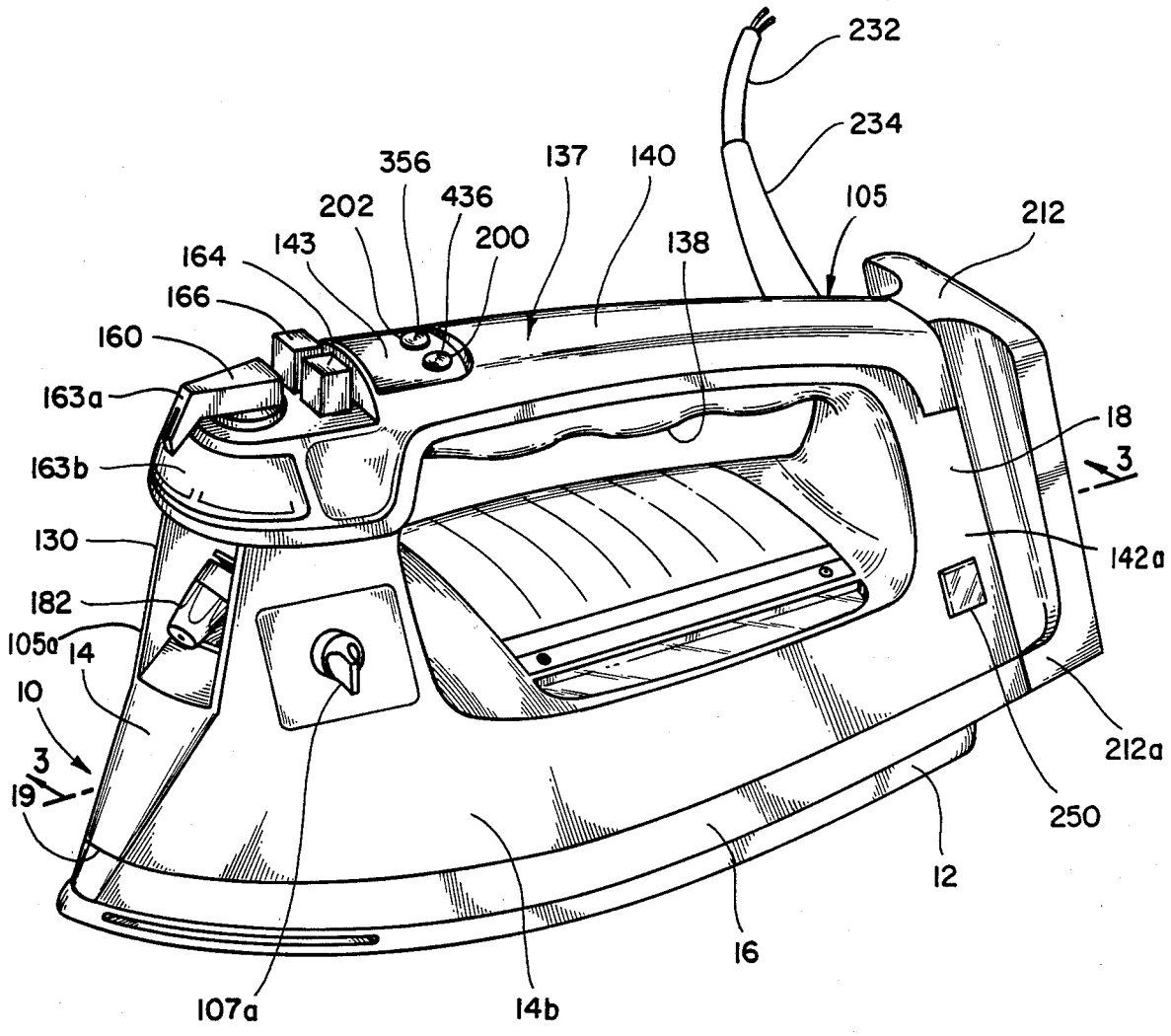
FIG. 1 is a perspective view of an electronic pressing iron embodying the present invention.
Figure 2:
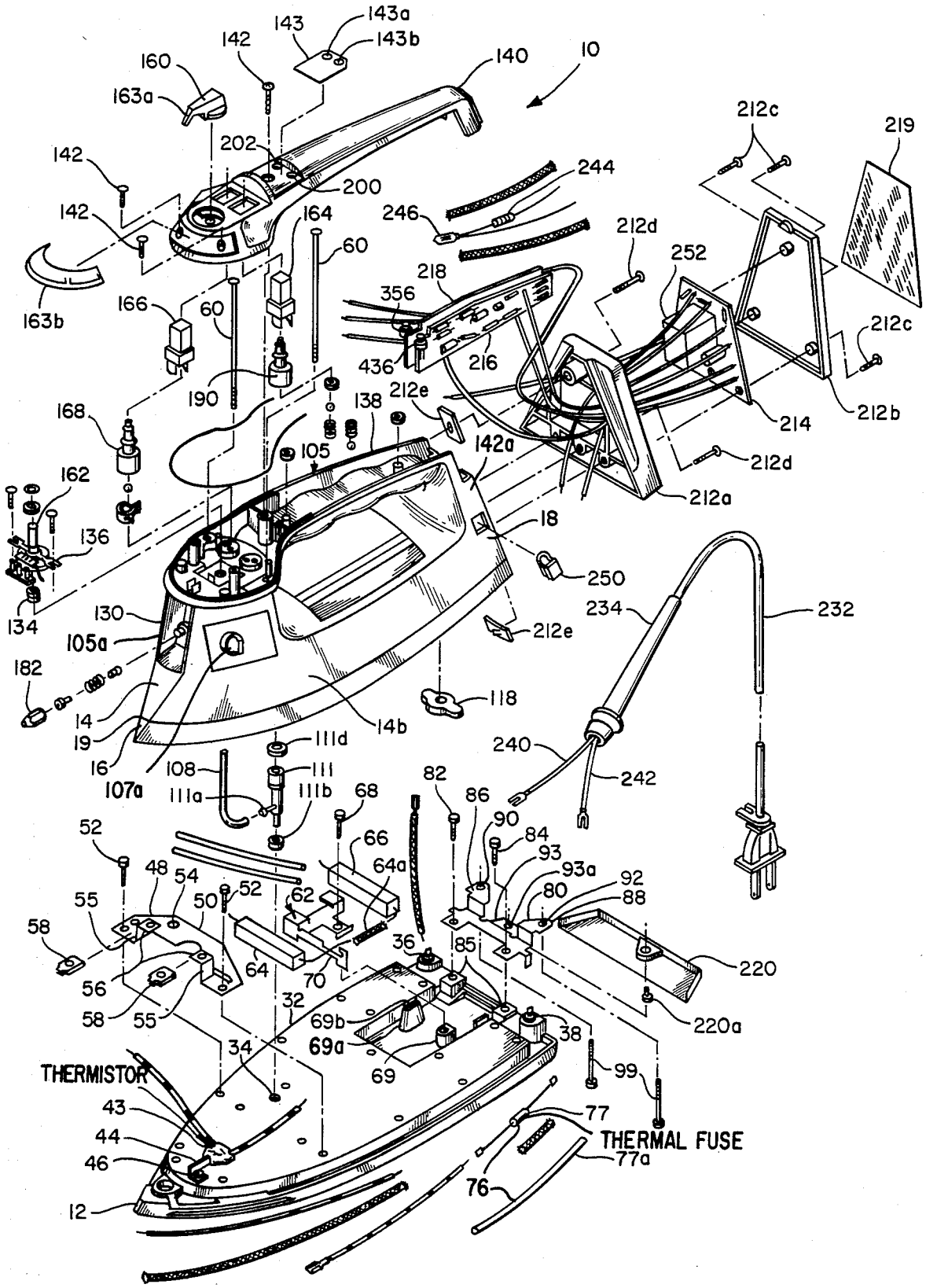
FIG. 2 is an exploded perspective view of the electronic pressing iron of FIG. 1.

Referring now to the drawings, and especially to FIGS. 1 and 2, an electronic pressing iron, generally indicated by numeral 10 and embodying the present invention is shown therein. The electronic pressing iron 10 has a cast aluminum soleplate 12. A plastic housing 14, having a right side **14*a* and a left side 14*b* and consisting of a phenolic lower housing 16 and a thermoplastic polyester upper housing 18, is connected to the soleplate 12**.

Figure 3:
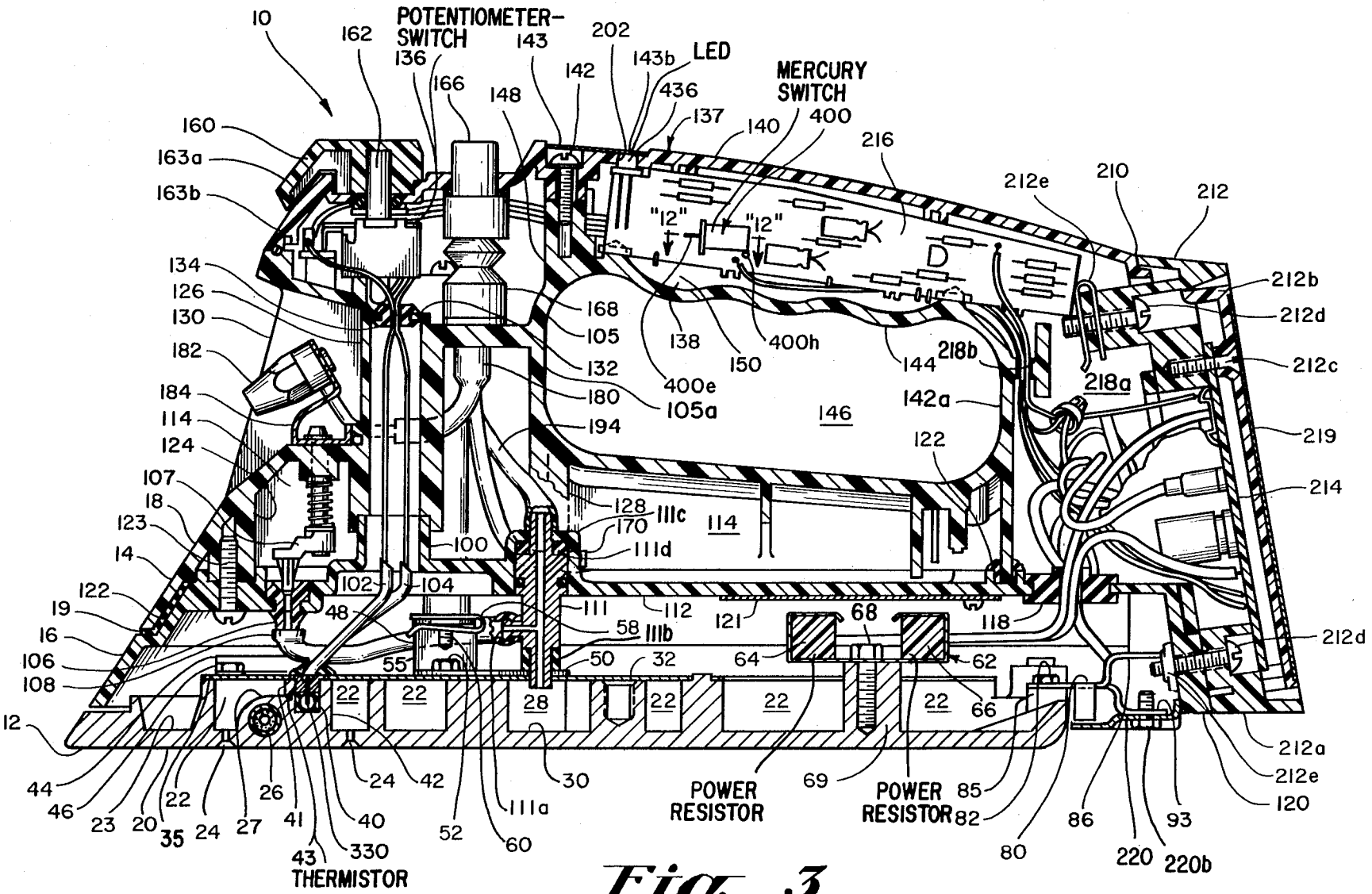
FIG. 3 is a sectional view of the electronic pressing iron of FIG. 1, taken generally along line 3—3 of FIG. 1, and showing details of the location of various mechanical components and printed circuit boards within the electronic pressing iron.
Figure 4:
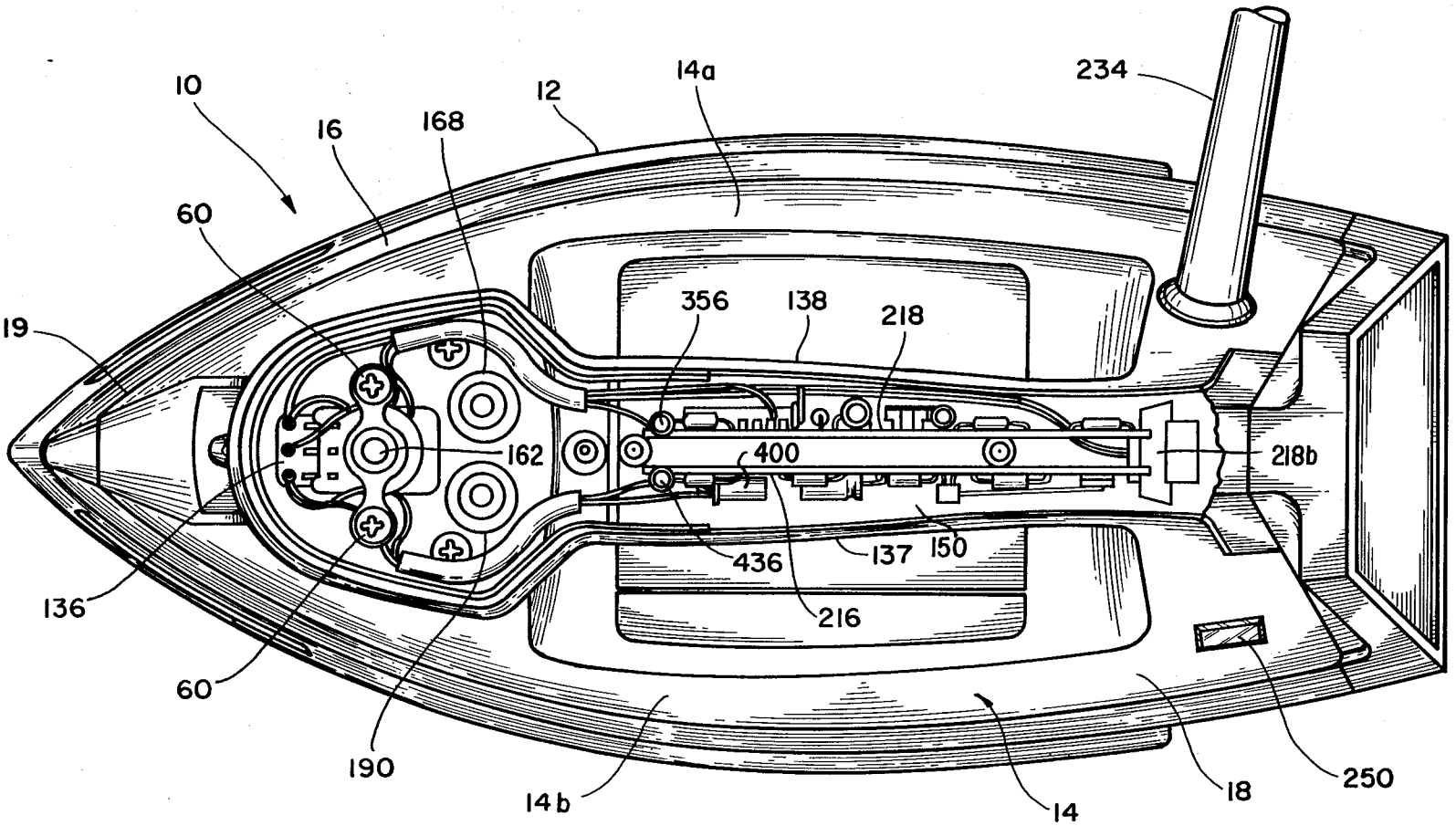
FIG. 4 is top plan view of the electronic pressing iron of FIG. 1 having portions of a handle and a heel rest assembly broken away to show details of the locations of the printed circuit boards and components mounted thereon.

Referring now to FIGS. 2 and 3, the phenolic lower housing 16 and the thermoplastic polyester upper housing 18 are sealed together with room temperature vulcanizing compound at a joint 19. The soleplate 12 has a bottom face or pressing surface 20 adapted to be placed in contact with a suitable fabric to be ironed. In addition, a plurality of open top labyrinthine steam passages 22 are formed on an upper side 23 of the soleplate 12 and are adapted to carry steam throughout the soleplate 12 and deliver the steam to a plurality of steam vents 24, two of which are shown in FIG. 3. The steam vents 24 open onto the pressing surface 20 and are particularly adapted to provide heated water vapor or steam to fabrics to be ironed in order to facilitate pressing. The steam is generated by an electric heating element 26, which is a conventional sheathed element and is formed within a rib 27 in the soleplate 12 in good heat transfer relationship with the pressing surface 20. The electric heating element 26 is adapted to dissipate 1250 watts of power at 120 volts. The electric heating element 26 supplies heat to the soleplate 12 and converts water to steam, the water being supplied from other portions of the iron.

The steam passages 22 include a flash or steam chamber 28 into which water is dripped from a suitable source, as will be discussed hereinafter. When the water contacts a heated bottom 30 of the flash chamber 28 it is converted to steam by the heat in the soleplate 12. The soleplate 12, as mentioned above, defines a portion of the open top steam passages 22 which are enclosed by a sheet metal steam chest cover 32. The steam chest cover 32 extends across almost all of the soleplate 12 and forms a sealed enclosure with the exception of the steam vents 24. A room temperature vulcanizing compound seals the outer edges of the steam chest cover 32 to the soleplate 12 at a joint 35. Water is delivered to the steam chamber 28 through a steam chamber opening 34 in the steam chest cover 32.

Figure 6:
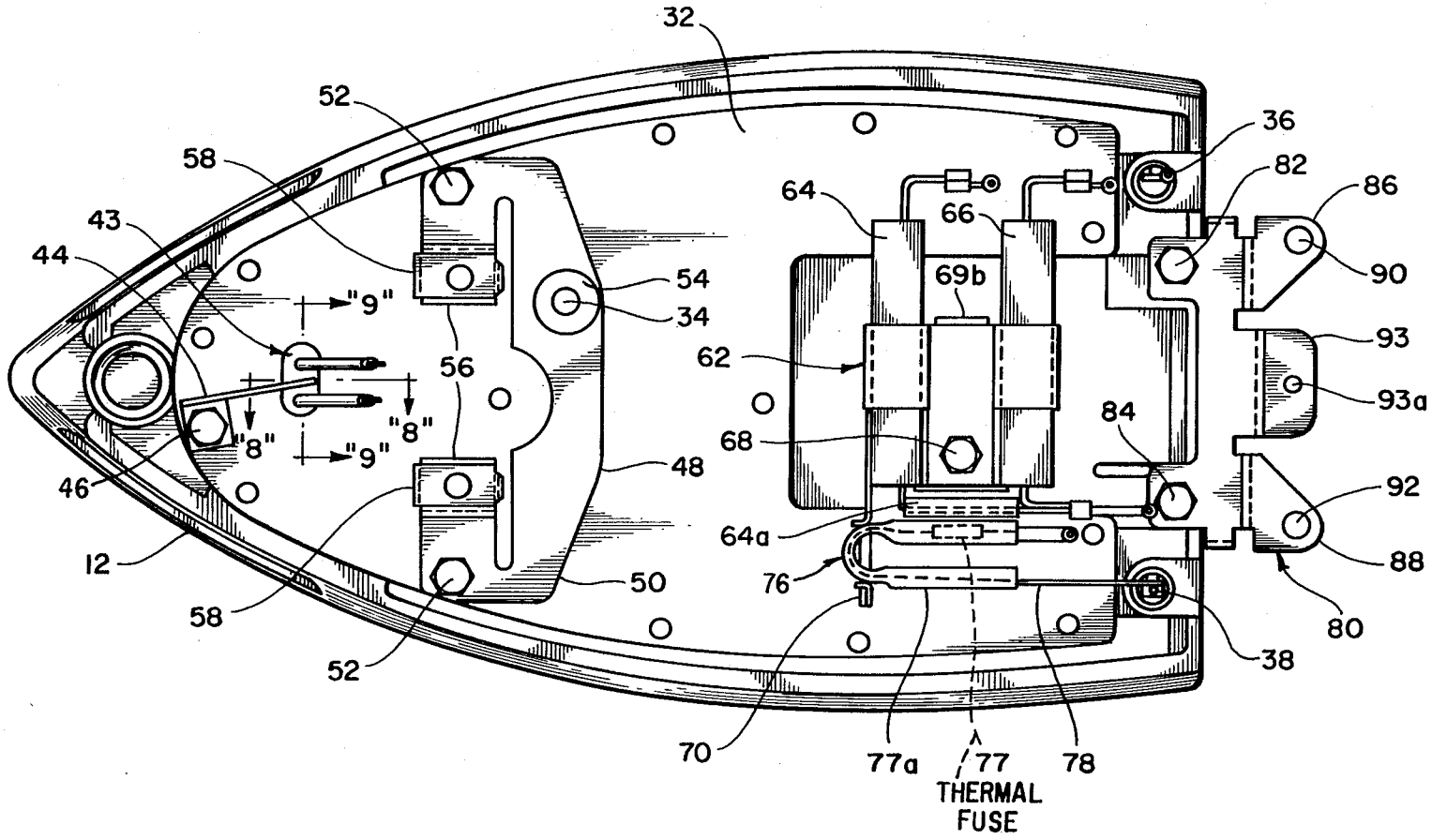
FIG. 6 is top plan view of a soleplate assembly of the electronic pressing iron of FIG. 1 with the housing removed showing details of the location of various components mounted above a steam chest cover of the soleplate.

In order to energize the heating element 26 a pair of heating element terminals respectively numbered 36 and 38, as may best be seen in FIG. 6, are provided.

In order to provide an accurate measurement of the temperature of the soleplate 12, the soleplate 12 includes a thermistor well 40 formed integral therewith between a rear wall 41 of a forward portion 41*a* of the rib 27 containing the heating element 26 and a forward portion 42 of the steam passages 22. The thermistor well 40 is adapted to receive a thermistor assembly 43, which will be described in further detail hereinafter. The thermistor assembly 43 is held within the well 40 in good heat conducting relationship with the soleplate 12 by a thermistor bracket 44, which is fastened by a screw 46 to the soleplate 12.

Figure 5:
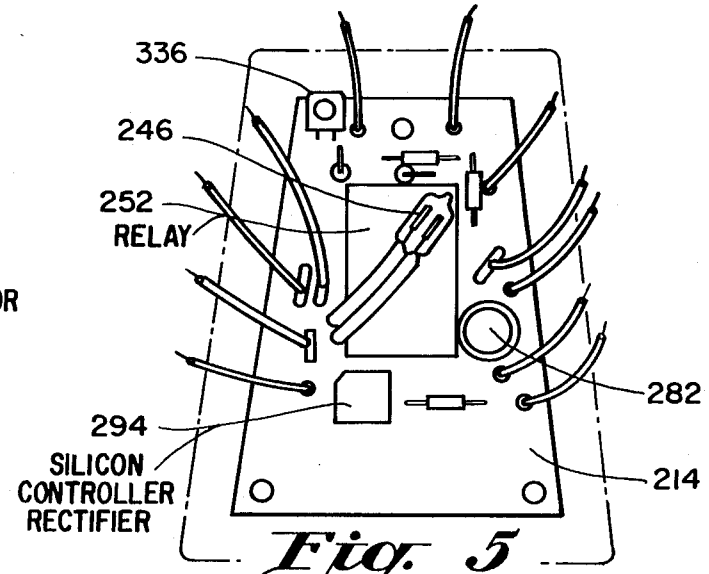
FIG. 5 is a plan view of the printed circuit board located in a heel rest of the electronic pressing iron of FIG. 1.

In order to secure the plastic housing 14 to the soleplate 12, a housing bracket 48, as best shown in FIGS. 2 and 5, is provided. The housing bracket 48 has a base portion 50 which is connected through the steam chest cover 32 to the soleplate 12 and held fixedly thereto by a plurality of screws 52. The housing bracket 48 has an aperture 54 which is in registry with the steam chamber opening 34 to allow water to flow into the steam chamber 28. The housing bracket 48 has a pair of upstanding leg portions 55 terminating at a pair of horizontal securing members 56 which are adapted for connection with the plastic housing 14 to secure it to the soleplate 12. Each of the horizontal securing members 56 has a sheet metal nut 58 interfitted therewith which receives an elongated screw 60 to hold the plastic housing 14 securely to the soleplate 12.

The soleplate 12 also has connected thereto a resistor bracket 62 which is adapted to support a pair of 3000 ohm, 10 watt ceramic power resistors, respectively numbered 64 and 66, above the soleplate 12. An insulating sleeve 64*a* covers a lead from the power resistor 64. The resistor bracket 62 is affixed to the soleplate 12 by a threaded fastener 68 which threadedly engages a perforated mount 69 formed integral with a rear portion of the soleplate 12. A locator mount 69*a*, having a locator lip 69*b*, is also formed integral with the soleplate 12 and engates the bracket 62. The resistor bracket 62 has an arm section 70 having a rectangular cutout which receives a thermal fuse assembly 76 and holds it in spaced relation above the soleplate 12, as best shown in FIG. 6. The thermal fuse assembly 76 includes a fuse 77, an insulating sleeve 77*a* surrounding it and in supporting engagement with the arm section 70. A fuse lead 78 is electrically connected to the heating element terminal 38 and to the fuse 77.

In order to complete the assembly of the plastic housing 14 to the soleplate 12, a heel bracket 80 is mounted by a pair of screws, respectively numbered 82 and 84, to a pair of perforated mounting blocks 85 formed integral with a rear portion of the soleplate 12. The heel bracket 80 includes a pair of engaging tail pieces 86 and 88 having respective apertures 90 and 92 formed therein for engagement with the phenolic lower housing 16 as will be discussed in greater detail hereinafter. The heel bracket 80 also includes an integral center tailpiece 93 having an aperture 93*a* formed therein.

The phenolic lower housing 16 is mounted above the soleplate 12 in spaced relation therefrom and is secured to the heel bracket tailpieces 86 and 88 by a pair of screws 99 which engage the apertures 90 and 92 and the phenloic lower housing 16. The lower housing 16 has, at a forward end thereof, a tower neck 100 through which a pair of insulated electrical leads 102 and 104 from the thermistor assembly 43 which are connected to respective bare thermistor leads 102*a* and 104*a* which are partially covered by respective high temperature glass-filled dielectric sleeves 102*b* and 104*b* which protect the bare leads 102*a* and 104*a*. The electrical leads 102 and 104 pass through and into an upper handle assembly 105 of the electronic pressing iron 10. The upper handle assembly 105 comprises a portion of a forward column 105*a*. The phenolic lower housing 16 also includes a water valve seat 106 into which a valve stem and pilot 107 selectively extends to control flow of water from a water tank to the steam chamber 28. The valve stem and pilot 107 are actuated by a control knob 107*a*. A water delivery tube 108 extends from the valve seat 106. The water delivery tube 108 is connected to a brass injector 111 at a side injector fitting 111*a*. The brass injector 111 engages a washer 111*b* and is seated in the steam chamber opening 34 to deliver water to the steam chamber 28. An upper portion of the injector 111 is connected in seating engagement with a hollow tubular boss 111*c* and a washer 111*d* in an upper wall 112 of the phenolic lower housing 16. The upper wall 112 defines a bottom wall of a water tank 114 in the plastic housing 14. Other portions of the water tank 114 are defined by portions of the upper housing 18.

In order to prevent moisture from entering areas of the electronic pressing iron 10 which contain printed circuit boards, a grommet 118 is fitted to the upper wall 112 for receipt of a plurality of conductive leads from the soleplate 12. The upper wall 112 is formed integral with a heel rest engaging member 120 at the rear portion of the iron and is in contact with a portion of the heel bracket 80. A sheet metal reflector 121 is connected to an underside of the upper wall 112 immediately above the power resistors 64 and 66 to minimize heat transfer from the power resistors to the plastic housing 14 and the electronic components contained therein.

The phenolic lower housing 16 is sealed about its periphery to the thermoplastic polyester upper housing 18 by room temperature vulcanizing compound 122 to form the reservoir 114. In addition, in order to hold the forward portions of the housing members 16 and 18 in engagement a plurality of threaded fasteners 123, one of which is shown, extends through the phenolic lower housing 16 to threadedly engage a sleeve 124 in the forward portion of the thermoplastic upper housing 18 immediately adjacent the water delivery tube 108. The upper housing 18 includes a tower 126 which is sealingly fitted to the tower cylinder 100 by a room temperature vulcanizing compound to protect from moisture the thermistor leads 102 and 104 which pass therethrough. Immediately behind the tower 126 is a portion of the water tank 114 which is defined by a vertical wall section 128. Forward of the tower 126 is a funnel section 130 into which water is poured in order to fill the water tank 114. Although not shown in FIG. 3, the inner end of the funnel 130 is wider than the tower 126 so that water flows around the tower 126 in a manner well known in the prior art in order to fill the water tank 114.

The thermistor leads 102 and 104 are protected from contact with water by the tower 126 and exit an upper section 132 of the tower 126 through a grommet 134. The thermistor leads 102 and 104 are connected to a combination potentiometer-switch 136 mounted in a handle portion 138 of the upper thermoplastic housing 18. The upper housing 18 includes a handle 137 comprised of a handle portion 138 and a handle cover 140 which is connected by a plurality of screws 142 to the handle portion 138. The handle 137 is connected to the forward column 105*a* and a rear column 142*a*. An escutcheon plate 143 having a pair of apertures 143*a* and 143*b* formed therein is fitted to the handle cover 140 and covers the screw 142.

The upper housing 18 also includes an integral gripping portion 144 which partially defines an opening 146 through which an operator's fingers may pass to grip the handle 137. The gripping portion 144 and the handle cover 140 also, together with a forward wall section 148, define a chamber 150 in the handle 137 for receipt of printed circuit boards as will be described in more detail later.

In order to provide ease of control for the electronic pressing iron 10, a control knob 160 is fitted to a stem 162 of the potentiometer-switch 136. The control knob 160 has a pointer 163*a* adapted to sweep past an indicating escutcheon plate 163*b* as is conventional in the art. In its furthest counterclockwise position, an ON/OFF switch within the potentiometer-switch 136 is opened to switch the electronic pressing iron 10 off, as will be described in more detail hereinafter. When the control knob 160 is rotated clockwise, the electronic pressing iron 10 is switched on and a temperature set point, selected by the potentiometer-switch 136, is raised with rotation, as will be described in further detail below.

Pump controls for spraying water and providing instant extra steam are provided immediately adjacent the handle so that the operator need merely reach out with his thumb to actuate them. An instant extra steam button 164 and a water spray button 166 are provided on the top cover of the electronic pressing iron 10. The water spray button 166, when depressed, activates a bellows pump 168 which draws water through a tube 170 located in water tank 114 up into the bellows pump 168 and forces the water out through a spray delivery tube 180 which delivers the water to a spray head 182 mounted on a bracket 184 mounted on one of the walls defining the funnel 130. The instant extra steam button 164, when depressed, activates a bellows pump 190 which draws an extra charge of water from the water tank 114 and delivers it through a tube 194 to the boss 111*b* onto which the tube 194 is fitted. The water flows through the boss 111*c* and through the injector 111 into the steam chamber 28 where the extra charge of water is converted to steam which flows out of the steam vents 24. The spray and steam features are disclosed in detail in U.S. Pat. No. 4,398,364 to Augustine et al. for STEAM IRON the disclosure which is incorporated by reference herein.

In order to further provide convenient controls and indicators in the instant electronic pressing iron 10 a pair of circular apertures, respectively numbered 200 and 202, are located immediately behind the instant extra steam and water spray buttons 164 and 166 in the handle. The apertures 200 and 202 receive respective light emitting diodes which provide a visual indication when the electronic pressing iron 10 is in various preselected states, as will be described in detail later on.

The handle cover 140 terminates at a rear portion 210 to which is interfitted with a heel rest assembly 212. The heel rest assembly 212 comprises a rear cover plate 212*a* with a rear cover insert 212*b* connected thereto by a plurality of screws 212*c*. The rear cover plate 212*a* is connected to the housing 14 by a plurality of screws 212*d* which engage respective sheet metal nuts 212*e*, one of which engages the upper plastic housing 18, the other of which engages the tailpiece 120 of the lower phenolic housing 18. The heel rest assembly 212 has a power control printed circuit board 214 mounted between the rear cover plate 212*a* and the rear cover insert 212*b*. The power control printed circuit board 214 is electrically connected to the soleplate 12 and to a pair of printed circuit boards 216 and 218 mounted in the handle chamber 150. A slot 218*a* is defined in the rear portion of the iron to receive leads connecting circuit boards 216 and 218 to the circuit board 214. An adhesive backed escutcheon 219 is adhered to the rear cover insert 212*b* and covers over the heads of the screws 212*c*. A closure plate 220 is secured by a screw 220*a* to the center portion 93 of the heel bracket 80.

Figure 10:
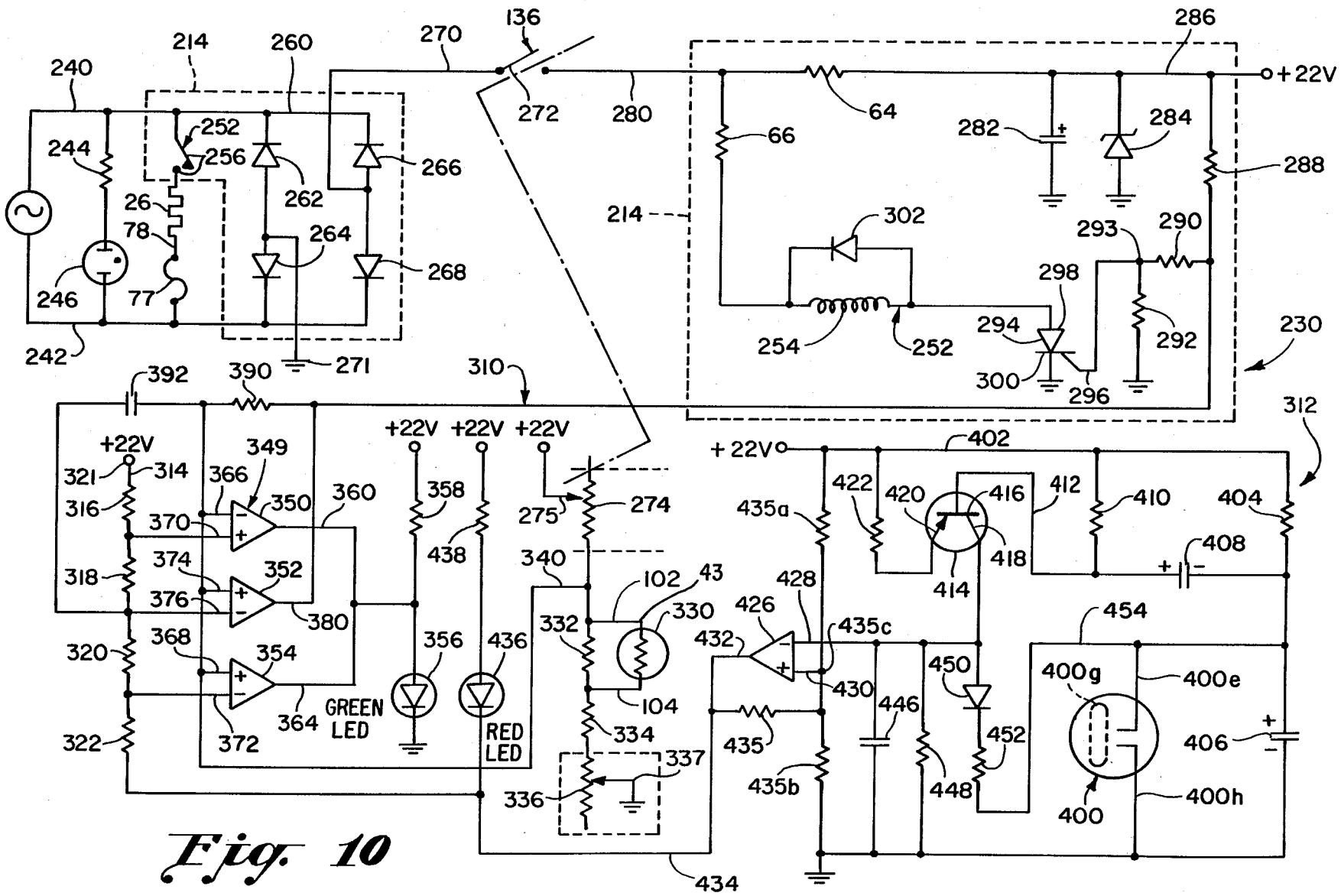
FIG. 10 is a schematic diagram of electronic control circuitry of the electronic pressing iron of FIG. 1.
Figure 11:
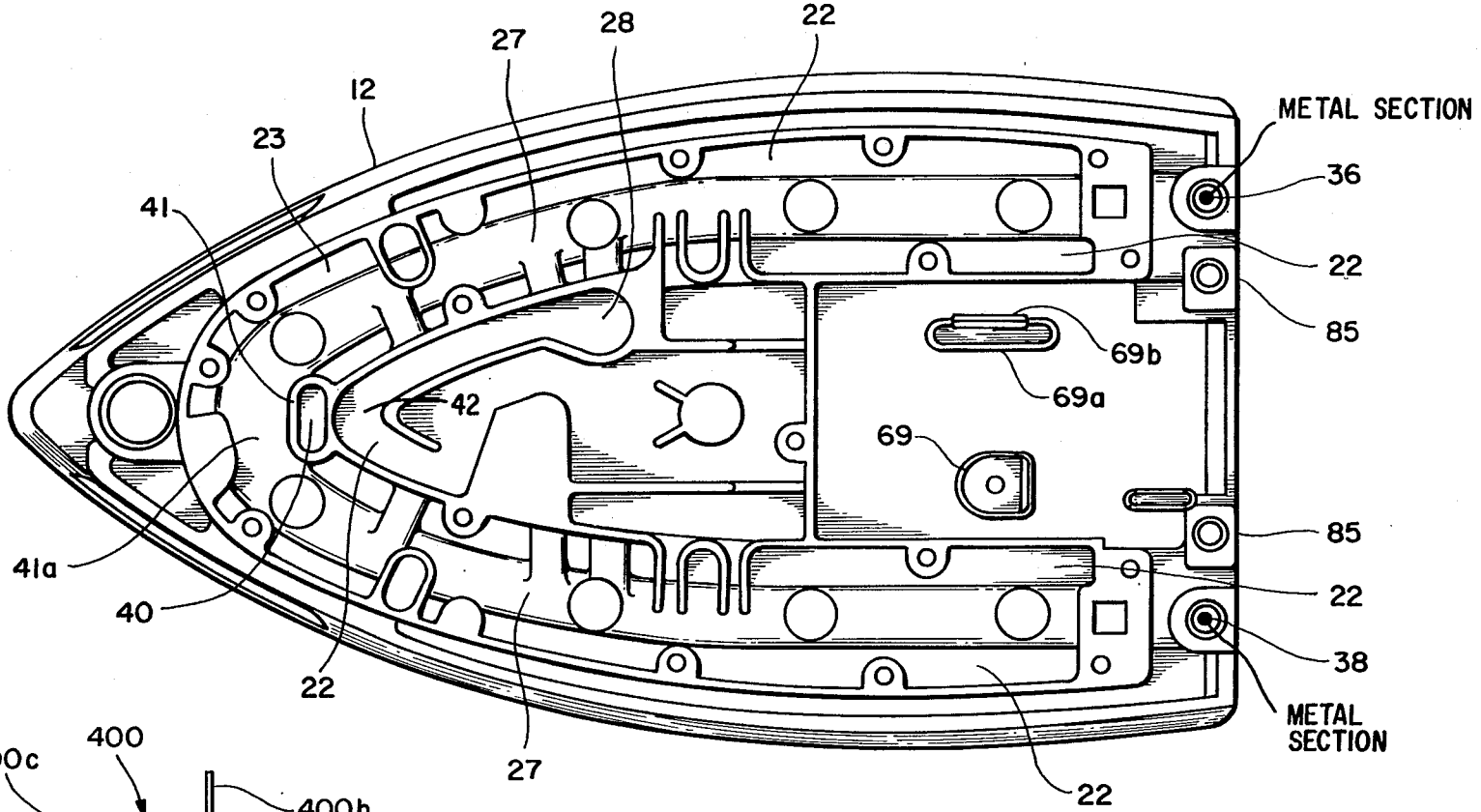
FIG. 11 is top plan view of the soleplate with the steam chest cover removed, showing details of the location of the elctric heating element, a plurality of steam passages and a thermistor well.

The heating functions of the soleplate 12 are controlled by a combination power control circuit, temperature sensing circuit and motion and attitude sensing circuit 230 which include the printed circuit boards 214, 216 and 218 and which may best be seen in FIG. 10. Alternating current electric power is delivered to the electronic pressing iron 10 through a power cord 232 which is received by a strain relief 234 fitted through an aperture in the upper thermoplastic polyester housing 18 of the electronic pressing iron 10. The power cord 232 includes a lead 240 and a lead 242 adapted to receive 120 volt alternating current from a suitable source. A 22 kilohm dropping resistor 244 and a neon lamp 246 are connected in series across the leads 240 and 242 so that when the power cord 232 is plugged in, the neon lamp 246 is illuminated. The resistor 244 and the neon lamp 246 are connected to the printed circuit board 214. The neon lamp 246 is mounted in registry with an amber colored plastic window 250 mounted in a side of the upper thermoplastic housing 18 for easy observation as is shown in FIGS. 1 and 2. Also connected across the leads 240 and 242 is the electric heating element 26 which is connected in series with the thermal fuse 77 of thermal fuse assembly 76. A relay 252 having a solenoid 254 and a pair of power contacts 256 has the power contacts 256 connected between the heating element 26 and the lead 240 to control the flow of alternating current therethrough. The relay 252 is a Model JC1aF purchased from Aromat Corporation, Mountainside, N.J.

In order to supply regulated current to other portions of the control circuit, a full-wave rectifier bridge 260 consisting of a plurality of diodes 262, 264, 266, and 268 is connected across the leads 240 and 242 and is mounted on the circuit board 214. A positive voltage direct current lead 270 is connected to a junction of the diodes 266 and 268. A ground lead 271 is connected to the junction of the diodes 262 and 264. Positive DC voltage is supplied by lead 270 to a single pole switch 272, which was previously described as part of the potentiometer-switch control 136. The other portion of the potentiometer-switch control 136 is a 100 kilohm, 20% taper potentiometer 274 which is mechanically connected to the single pole switch 272 and has a tap 275 connected to receive a positive 22 volt potential. The single pole switch 272 is connected to a lead 280 which feeds full wave rectified current to the power resistors 64 and 66 previously described. The power resistor 64 is connected to a 220 microfarad electrolytic smoothing capacitor 282 which is also connected to ground. A Zener diode 284 having a 22-volt Zener potential, is connected across the smoothing capacitor 282 and provides a regulated positive 22 volt potential plus or minus 2.2 volts to a lead 286. The lead 286 is connected to an 8.2 kilohm resistor 288 which is series connected to a 5.6 kilohm resistor 290 and a 1 kilohm grounded resistor 292.

A junction 293 of the resistors 290 and 292 is connected to a 2N5064 silicon controlled rectifier or thyristor 294 at a gate 296. An anode 298 of the silicon controlled rectifier 294 is connected to the relay 254. The cathode 300 of the silicon controlled rectifier 294 is connected to ground. The relay solenoid 254 is also connected to the power resistor 66 to receive a 24 volt operating voltage. A 1N4004 diode 302 is connected in parallel with the relay solenoid 254 to prevent damage to the silicon controlled rectifier 294 when current flow is quickly interrupted. The diode 302 also provides a discharge path for the counter-EMF present across the relay 254 when the silicon controlled rectifier 294 switches off. Thus, the silicon controlled rectifier 294 controls the relay 252 which enables or disables the electric heating element 26.

The silicon controlled rectifier 294 is, in turn, controlled by a temperature sensing circuit 310 which is enabled or disabled by an attitude and motion sensing circuit 312. Referring first to the temperature sensing circuit 310, the circuit includes a reference voltage divider 314 having a plurality of series connected resistors 316, 318, 320 and 322 which receive a positive 22 volt potential from the lead 286 at a terminal 321. The resistor 316 is a 47 kilohm resistor. The resistor 318 is a 9.1 kilohm resistor. The resistor 320 is a 6.8 kilohm resistor. The resistor 322 is a 47 kilohm resistor. The voltage divider 314 provides a plurality of stable, fixed reference voltages to other portions of the circuit.

The positive 22 volt potential is also fed to the tap 275 of the potentiometer 274. The potentiometer 274 is connected in series with a PH65DIA thermistor 330 comprising a portion of the thermistor assembly 43 and which is connected in parallel with a 180 kilohm resistor 332 to linearize the response of the thermistor 330. The resistor 332 is connected in series with a 6.8 kilohm resistor 334 and a 10 kilohm calibrating potentiometer 336 having a tap 337. The tap 337 of the calibrating potentiometer 336 is connected to ground.

Figure 8:
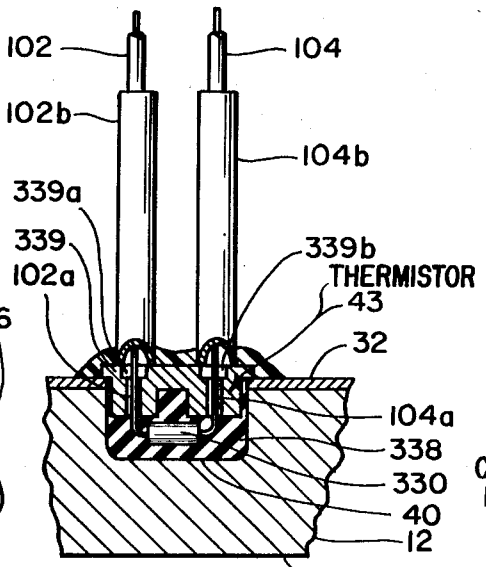
FIG. 8 is an enlarged fragmentary sectional view of a portion of a soleplate, taken generally along line 8—8 of FIG. 6, showing details of a temperature sensing thermistor mounted within the soleplate.
Figure 9:
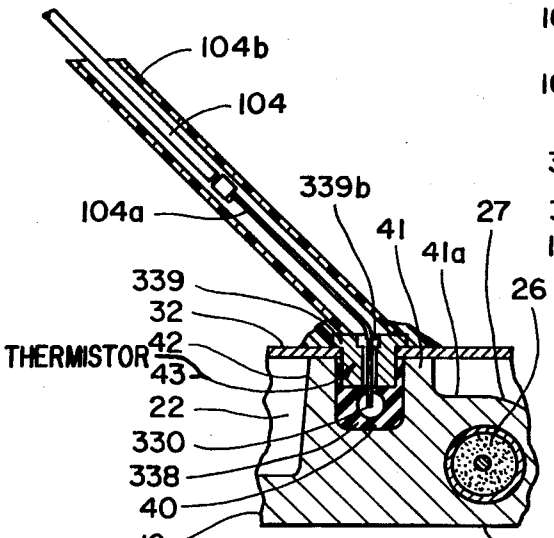
FIG. 9 is an ennlarged fragmentary sectional view, taken generally along line 9—9 of FIG. 6, of a portion of the soleplate and the thermistor showing details of the location of an electric heating element and a steam chamber in relation to the thermistor.
Figure 7:
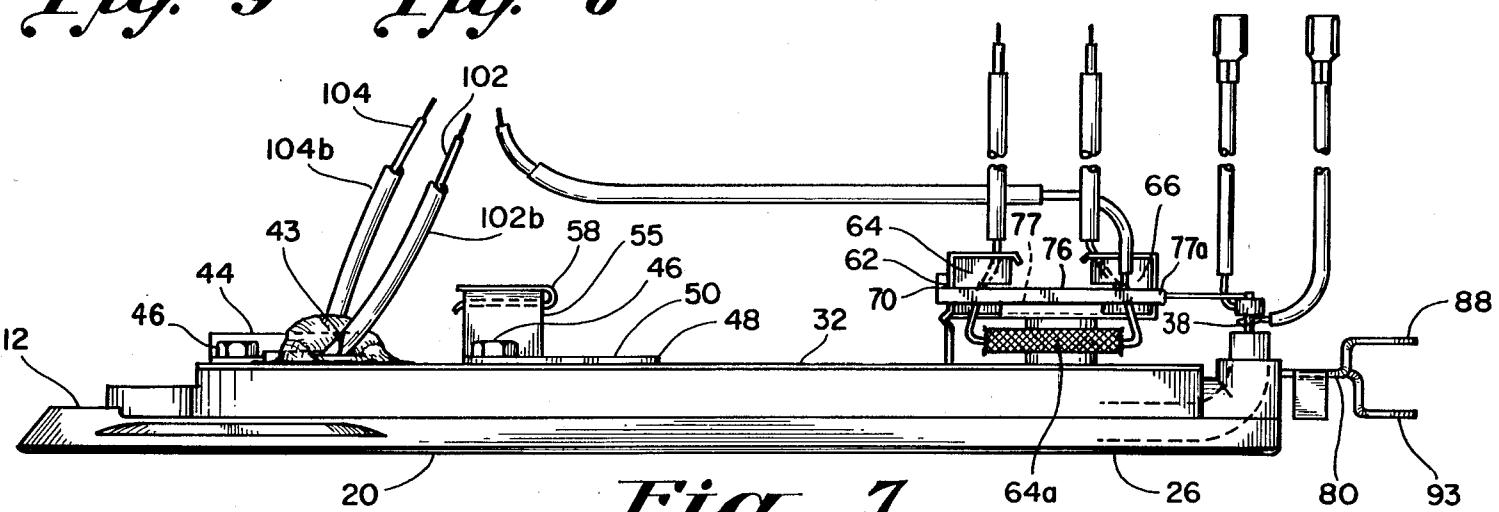
FIG. 7 is a side elevational view of the soleplate and associated components shown in FIG. 5 having a fuse assembly removed in order to show details of a pair of power resistors.

The thermistor 330, as may best be seen in FIGS. 8 and 9, is surrounded by a potting compound 338 which fills the thermistor well 40 and consists of a mixture of room temperature vulcanizing plastic and a good heat conductor. The potting compound 338 is obtained from the Dewey and Almy Chemical Division of W. R. Grace and Co., Canton, Mass., and is identified as ECCOSIL 4954. A ceramic insulator cap 339, which insulates the thermistor leads 102 and 104 electrically from the soleplate 12 and the steam chest cover 32, connects the insulated leads 102 and 104 to the bare conductors 102*a* and 104*a* which are enclosed in respective high temperature, glass filled, dielectric sleeves 102*b* and 104*b* extending through a pair of respective apertures 339*a* and 339*b* in the ceramic insulator cap 339. Additional room temperature vulcanizing compound covers the top of the ceramic insulator cap 339 to flexibly bond the sleeves 102*b* and 104*b* to the ceramic insulator cap 339. Temperature signals from the thermistor 330 are picked off by a lead 340 at a junction between the potentiometer 274 and the thermistor 330.

The temperature signals from lead 340 are fed to an LM339N integrated circuit which comprises a plurality of comparators 349 including a comparator 350, a comparator 352 and a comparator 354. The comparators 350 and 354 together comprise a window comparator which functions solely to provide a signal to a Toshiba TLG147 green light emitting diode 356. The green light emitting diode 356 is mounted in registry with the aperture 202 and is connected to a 3.3 kilohm pullup resistor 358, which is energized by the positive 22 volt potential. The comparators 350 and 354 are adapted to simultaneously sink currents at their respective output terminals 360 and 364 only when the temperature signal received at their respective inverting input terminal 366 and noninverting input terminal 368 lies between the reference potentials supplied by the voltage divider 314 to a noninverting terminal 370 and an inverting terminal 372. Thus, the green light emitting diode 356 is only illuminated when the soleplate 12 is typically operating within a temperature of plus or minus thirty degrees Centigrade of the setpoint temperature selected by the potentiometer 274, indicating to the user that the soleplate 12 is at the selected temperature and that the electronic pressing iron 10 is ready to use.

Furthermore, when the temperature signal at lead 340, which is representative of the temperature of the thermistor 330, is supplied to a noninverting terminal 374 of the comparator 352 and exceeds the fixed reference voltage at the junction of resistors 318 and 320, an output terminal 380 of the comparator 352 is driven high, biasing the resistor 290 high and switching the silicon controlled rectifier 294 on to close the relay contacts 256, thereby delivering electric current to the electric heating element 26 to heat the soleplate 12. When the thermistor 330 is heated by the soleplate 12 sufficiently to switch the output terminal 380 of the comparator 352 to a low voltage by sinking current, the silicon controlled rectifier 294 is switched off, allowing the relay contacts 256 to open.

In order to improve the performance of the temperature control comparator 352, a 3.4 megohm resistor 390 is connected across its output terminal 380 and its noninverting terminal 374 to provide hysteresis in order to eliminate chatter of the relay 250. A 0.47 microfarad nonpolarized electrolytic capacitor 392 is connected across the input terminals 374 and 376 of the temperature control comparator 352 to bypass high frequency noise in order to prevent false switching of the temperature control comparator 352.

In order to protect users of the electronic pressing iron 10 who may inadvertently leave it on when it is in the heel rest position, or who may leave the iron unattended when the soleplate 12 is horizontal with the soleplate 12 in contact with a fabric, the attitude sensing circuit 312 is provided.

Figure 12:
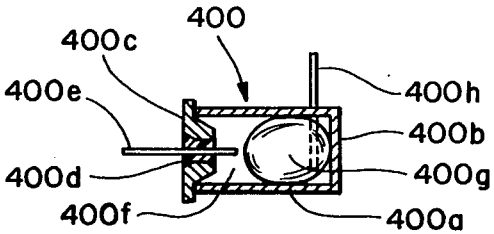
FIG. 12 is a sectional view of a mercury switch taken generally along line 12—12 of FIG. 3.

The attitude and motion sensing circuit includes a mercury switch 400 which senses both attitude and motion of the electronic pressing iron 10. The mercury switch 400, as may best be seen in FIGS. 3 and 12, is mounted on the printed circuit board 216 in the handle 137 and oriented at an angle of 5.5 degrees plus or minus 0.5 degrees to the soleplate 12. The mercury switch 400 consists of a cylindrical metallic wall 400*a* having a circular end wall 400*b* formed integral therewith. A metallic conducting end cap 400*c* is connected to the cylindrical wall 400*a* opposite the end wall 400*b* and has a central aperture having an insulating plastic insert 400*d* held therein. A central electrode 400*e* passes through the insulator 400*d* and terminates in a cavity 400*f* defined by cylindrical wall 400*a*, cap 400*c*, insulator 400*e* and end wall 400*b*. The cylindrical wall 400*a*, the end wall 400*b* and the end cap 400*c* comprise a first contact. The central electrode 400*e* comprises a second contact. A quantity or pool of mercury 400*g* is confined within cavity 400*f* and is free to move about therein. A tangential electrical connector 400*h* is welded to the cylindrical wall 400*a*. It may be appreciated that the mercury switch 400 is closed when the quantity of mercury 400*g* creates a bridging connection between the electrode 400*e* and either end cap 400*c*, cylindrical wall 400*a*or end wall 400*b*. When such a connection is made, the capacitor 406 is rapidly discharged due to the shunting effect of the mercury droplet or pool 400*g*. It may also be appreciated that the mercury switch 400 is positioned within the iron so that the end wall 400*b* is slightly lower than the end cap 400*c*. The mercury switch 400 is relatively easy to position since the leads 400*h* and 400*e* confine it to the proper orientation with respect to the printed circuit board 216. The attitude sensing circuit 312 operates so that when the electronic pressing iron 10 is resting with its heel rest assembly 212 horizontal (in the "heel rest position"), the contacts of the mercury switch 400 are open. When the electronic pressing iron 10 is horizontal and is moving, the contacts of the mercury switch 400 are opening and closing as the mercury droplet 400*g* moves within the cavity 400*f*. When the electronic pressing iron 10 is resting with the soleplate 12 horizontal and the electronic pressing iron 10 is not moving, the contacts of the mercury switch 400 are closed.

When the electronic pressing iron 10 is initially energized, direct current at a positive 22 volt potential flows through a lead 402 into a 15 kilohm resistor 404 which is connected to the lead 402. A 22 microfarad electrolytic capacitor 406, which is connected to the resistor 404 and to ground, is charged up. During charging of the electrolytic capacitor 406, a pulse is supplied to a 47 microfarad electrolytic capacitor 408, which is connected to the electrolytic capacitor 406 and to a 15 kilohm resistor 410. The electrolytic capacitor 408 and the resistor 410 comprise a differentiator which differentiates the incoming pulse and supplies a very short duration pulse to a lead 412 as will be explained in greater detail hereinafter.

A 2N3906 PNP charging transistor 414 having a base 416, a collector 418 and an emitter 420 is connected at its emitter 420 to a 33 ohm resistor 422, which is biased at positive 22 volts potential by the lead 402. The collector 418 is connected to a lead 424.

A comparator 426 having an inverting terminal 428, a noninverting terminal 430 and an output terminal 432 is connected at its output terminal 432 to a lead 434. A 2.2 megohm resistor 435 is connected between the output terminal 432 and the noninverting input terminal 430 to provide hysteresis to the comparator 426 and help prevent false switching. A 1.0 megohm resistor 435*a* and a 270 kilohm resistor 435*b* are series connected as a voltage divider between the 22 volt source of regulated potential and ground. A junction 435*c*, between the resistors 435*a* and 435*b*, is connected to the noninverting terminal 428 to supply a regulated reference voltage to it. The lead 424 is connected to the inverting terminal 428 to supply a timing voltage to it, as will become apparent hereinafter. The lead 434 is connected to a Toshiba TLG 147 red light emitting diode 436 which receives current through a 3.3 kilohm pullup resistor 438 from the lead 286. The red light emitting diode 436 is aligned in registry with the apertur 200 and indicates when the heating element 26 is not disabled. As long as the output terminal 432 of the comparator 426 is at a low voltage or is sinking current, the red light emitting diode 436 is illuminated and a normal bias from the resistors 318 and 320 is supplied to the inverting terminal 376 of the temperature control comparator 352, allowing it to control the temperature of the soleplate 12 as previously described. When the output terminal 432 goes high, the red light emitting diode 436 switches off, the inverting terminal 376 is driven high, pulling the output terminal 380 low and switching the silicon controlled rectifier 294 off regardless of the temperature of the soleplate 12.

The attitude and motion sensing circuit 312 also includes a 22 microfarad electrolytic timing capacitor 446 having a 12 megohm bleeder resistor 448 connected in parallel with it. Both the timing capacitor 446 and the bleeder resistor 448 are connected between the lead 424 and ground. They are each also connected to the inverting terminal 428 of the comparator 426 to supply a timing voltage to it. Additionally, a 1N914 switching diode 450 and a 680 kilohm resistor 452 are connected in series to the lead 424 and to the collector 418 of the charging transistor 414. The resistor 452 is connected to a lead 454 which has the mercury switch 400 connected across it. The mercury switch 400 is also connected to ground and to the electrolytic capacitor 406.

In normal operation, when the electronic pressing iron 10 is first powered up, the transistor 414 is switched conducting by base current from the capacitors 406 and 408 as they initially charge up. The transistor 414 rapidly charges the timing capacitor 446 to full charge. In the event that the electronic pressing iron 10 is left with the soleplate 12 in a horizontal position or if the electronic pressing iron 10 is lying on its side l4*a* or l4*b*, the mercury switch 400 is closed and the timing capacitor 446 quickly discharges through the diode 450, the resistor 452 and the mercury switch 400. Due to the relatively low resistance of the resistor 452 the timing capacitor 446 discharges in approximately 30 seconds, pulling the voltage of the lead 424 low, switching the output terminal 432 of the comparator 426 low, causing the output voltage of the temperature control comparator 352 to go low and interrupting any current that may be flowing to the silicon controlled rectifier 294.

In the event that the electronic pressing iron 10 is in the heel rest position, the mercury switch 400 remains open and the timing capacitor 446 discharges in approximately ten minutes through the bleeder resistor 448, again, switching comparator 426 low and comparator 352 to disable the silicon controlled rectifier 294.

In the event that the electronic pressing iron 10 is oriented with the soleplate horizontal and is moving, the mercury switch 400 intermittently opens and closes as a result of acceleration of the iron 10, causing the voltage at the lead 454 to vary in a pulse-like fashion due to the capacitor 406 being discharged and charged. These pulses are differentiated by the capacitor 408 and the resistor 410 and fed as extremely short pulses to the base 416, thereby switching transistor 414 on and provide bursts of charging current to the timing capacitor 446 from the resistor 422 to maintain it at a full charge.

It may be appreciated that the electronic pressing iron 10 may be quickly and easily set at a desired temperature by the control knob 160. As the iron is heating up, the red light emitting diode 436 is illuminated to provide an indication to the user that the soleplate 12 is heating up but not yet ready for use. Once the soleplate 12 reaches operating temperature, the green light emitting diode 356 is illuminated, thereby indicating to the user that the electronic pressing iron 10 is ready for use.

Since the electronic circuit 230 controls the temperature of the soleplate 12 to within ±5° Centigrade, and in particular because the thermistor 330 is located between the heating element 26 and the steam chamber 28, when the soleplate 12 is operating at low temperature setpoints, the addition of extra water to the flash chamber 28 when the instant extra steam button 164 is pressed will not cause the flash chamber 28 to drop below the steaming temperature, but rather any reduction in temperature will be rapidly sensed by the thermistor 330 which will cause the relay 252 to close, energizing the heating element 26 to insure that the soleplate 12 maintains the setpoint temperature.

In addition, the electronic pressing iron 10 not only has accurate temperature control to prevent damaging delicate fabrics and provide uniform steaming, but also has the safety features of the motion and attitude circuit 312 whereby if the electronic pressing iron 10 ceases moving with the soleplate 12 in a horizontal position, electric power to the heating element 26 is interrupted within 30 seconds of iron movement ending. Should the iron be left unattended on its heel rest 212, electric power to the heating element 26 will be interrupted within 10 minutes after the iron is placed on its heel rest 212.

In the event that the iron is oriented with the soleplate 12 down, has not been moving for a length of time, and is moved, the mercury switch 400 opens and closes, re-enabling the temperature control circuit 310, and causing the heating element 26 to re-energize. Similarly, if the iron is left in the heel rest position for more than 10 minutes and then is moved into the soleplate horizontal orientation, the timing capacitor 446 is recharged and the heating element 26 is re-enabled.

While there has been illustrated and described a particular embodiment of the present invention, it will be appreciated that numerous changes and modifications will occur to those skilled in the art and it is intended in the appended claims to cover all those changes and modifications which fall within the true spirit and scope of the present invention.

What is claimed as new and desired to be secured by Letters Patent of the United States is:

1. A pressing iron comprising: a housing; a soleplate connected to said housing; an electric heating element mounted in good heat conducting relationship with said soleplate; means for controlling an electric current connected to said electric heating element and being adapted to receive an electric current from a suitable source of electric current and to selectively supply said electric current to said electric heating element; and first sensing means for responding to the orientation and motion of said soleplate, said first sensing means being connected to said means for controlling said electric current to supply said electric current to said electric heating element in response to detection by said first means of soleplate motion with said soleplate oriented horizontally indictaive of iron use and to interrupt said electric current to said electric heating element in response to detection by said first means of lack of motion of the soleplate for a predetermined period of time with said soleplate oriented horizontally indicative of iron non-use and to interrupt said electric current to said electric heating element in response to detection by said first means of said soleplate being oriented substantially upright and motionless in a storage position.

2. A pressing iron as defined in claim 1 wherein said predetermined period of time is sufficiently short to prevent scorching of fabrics being ironed when said iron remains immovable with said soleplate in said horizontal position for said predetermined length of time.

3. A pressing iron as defined in claim 1 wherein said first sensing means responds to the orientation of said iron with the soleplate in the substantially vertical storage position to discontinue said supply of electric current after said iron remains in said storage position for a second predetermined length of time.

4. A pressing iron as defined in claim 3 including a second sensing means for sensing temperature mounted in good heat transfer relationship with the soleplate and connected to said means for controlling said electric current in order to maintain a preselected temperature at said soleplate.

5. A pressing iron comprising: a housing; a soleplate connected to said housing; an electric heating element mounted in good heat conducting relationship with said soleplate; means for controlling an electric current connected to said electric heating element and being adapted to receive an electric current from a suitable source of electric current and to selectively supply said electric current to said electric heating element; and first sensing means for responding to the orientation and motion of said soleplate, said first means being connected to said means for controlling said electric current to supply said electric current to said heating element in response to detection by said first means of motion of said soleplate in a horizontal position indicative of iron use and to interrupt said electric current in response to detection by said first sensing means of lack of motion of said soleplate in a horizontal position indicative of iron non-use; said first sensing means responsive to orientation and motion comprising a mercury switch having spaced contacts which are closed by a pool of mercury, said contacts being disposed in horizontally spaced relationship such that with said soleplate positioned motionless in a horizontal plane said pool of mercury closes said contacts, and horizontal movement of said soleplate in the horizontal position causes movement of said pool of mercury to periodically open and close said contacts, said contacts and said pool of mercury being so disposed that with said soleplate placed in a substantially vertical storage position said contacts are opened to cause said current control means to interrupt said electric current to said heating element.

6. A pressing iron as defined in claim 4 wherein said soleplate has a pointed forward end, a rear heel position and interconnecting side edges, said switch contacts and said pool or mercury are disposed so that said contacts are closed by said mercury pool whether said soleplate is horizontal or tilted on oe of its side edges, said contacts and saaid mercury pool being disposed so that said mercury switch is open when said soleplate is positioned with its forward end upward and its heel position downward.

7. A pressing iron as defined in claim 6 wherein said mercury switch comprises a closed cylinder of conductive material partially filled with mercury and a contact extending coaxially into said cylinder from one end and being insulated from the cylinder, said cylinder comprising another contact of said switch and being disposed with its axis extending from the forward portion and to the rear end parallel to said soleplate.

8. A pressing iron as defined in claim 6 wherein said mercury switch is connected to a timer forming part of said current controlling means so that said timer controls said electric current through said heating element in response to a signal from said mercury switch.

9. A pressing iron as defiend in claim 8 wherein said timer comprises a resistance-capacitance network including a capactior adapted to be charged through a transistor connected to a voltage source, said transistor supplying charging current to said capacitor when said pool of mercury opens and closes said switch contacts periodically, a resistor connected to said capacitor being adapted to discharge said capacitor through said resistor and said switch contacts when said pool or mercury closes said switch contacts.

10. A pressing iron comprising: a soleplate; a housing connected to said soleplate; an electric heater in good heat transfer relationship with said soleplate; switch means in series with said electric heater and adapted for connection to a suitable external source of electric current for controlling the electric current to said electric heater; motion sensing means responsive to horizontal movement of said soleplate in a horizontally disposed position for generating a first electrical signal; position sensing means responsive to said soleplate being disposed horizontally and said soleplate motionless for generating a second electrical signal, said position sensing means generating a third electrical signal in repsonse to said soleplate being positioned in a substantially vertical storage position, said switch means being response to said first electrical signal to allow said electric current to energize said electric heater, said switch means being responsive to said second and third electrical signals to interrupt electric current to said electric heater.

11. A pressing iron as defined in claim 10 wherein said motion sensing means and said position sensing means comprise a sensing switch having spaced contacts which are closed by a pool of conductive liquid; said soleplate having a pointed front end portion and a rear heel portion; said housing being adapted to support said iron in an upended storage position with said soleplate substantially vertical with said front end portion uppermost and said heel portion downward; said contacts having portions spaed from each other lengthwise of said soleplate with one contact toward the front portion and portions of the other contact toward the rear so that said contacts are closed by said pool of conductive liquid when said soleplate is motionless and disposed horizonally to generate said second signal and are open when said iron is in the storage position to generate said third signal.

12. A pressing iron as defined in claim 11 wherein movement of said soleplate in the horizontal position causes said contacts to open intermittently as a consequence of the flow of said pool of conductive liquid as said iron is moved to generate said first signal.

13. A pressing iron comprising: a soleplate; a housing connected to said soleplate; means for electrically heating said soleplate in good heat transfer relationship with said soleplate; means for controlling an electric current connected to said means for electrically heating said soleplate and adapted to receive an electric current from a suitable external source; and means for sensing motion connected to said means for controlling said electric current and comprising an inertial mass and signal generating means in association with said inertial mass, said signal generating means generating a first signal responsive to said soleplate being positioned horizontally and said housing and said soleplate being accelerated horizontally, said signal generating means generating a second signal responsive to said soleplate being positioned horizontally and said housing and said soleplate motionless, said signal generating means generating a third signal responsive to said soleplate being positioned vertically said means for controlling said electric current responding to said first electrical signal to allow said electric current to energize said means for electrically heating said soleplate, said means for controlling said electric current responding to said second and third electrical signals to interrupt said electric current to said means for electrically heating said soleplate upon receipt thereof.

14. A pressing iron having circuit means for disabling a heating element to eliminate overheat hazards, comprising: a soleplate having a pressing surface and an electric heating element in good heat transfer relation therewith; a housing mounted on said soleplate and including a water reservoir for supplying water to said soleplate to be vaporized and a handle, means on said housing for supporting said pressing iron in an upended position with said soleplate out of contact with a supporting surface; switch means sensing the position and movement of the pressing iron in the ironing position with the pressing surface disposed horizontally and sensing the position of the pressing iron in the upended position; and timing means responsive to said switch means for disabling said heating element if said pressing iron remains motionless for a first predetermined period of time in said ironing position and if said pressing iron remains in said upended position for a second predetermined period of time which substantially exceeds said first predetermined period of time.

15. A pressing iron as defined in claim 14 wherein said switch means comprises a level switch having spaced contacts which are open when said pressing iron is in the upended position and closed when said pressing iron is motionless in the ironing position, movement of said pressing iron in said ironing position causing said contacts to be intermittently opened.

16. A pressing iron as defined in claim 15 wherein said contacts comprise a first cylindrical contact and a second coaxially disposed contact at one end of said cylindrical contact, said cylindrical contact having a closed end wall with said second contact supported at the other end by an insulating portion, said cylindrical contact and said insulating portion form in a container for a pool of conducting liquid, said contact being disposed with the axis of said cylindrical contact in a plane substantially parallel with said pressing surface, said second contact being vertically spaced from said conducting liquid when said iron is in an upended position, said liquid closing said contacts when said iron is motionless in said ironing position or tilted on its side.

17. A pressing iron comprising: a metal soleplate; an electric heater mounted in good thermal conducting relationship with said soleplate and having means for connecting it to an electric current from a source of electric current; a housing connected to said soleplate, said housing including a handle and a heel rest for supporting the pressing iron in an upended rest position; means for for sensing a temperature of said soleplate mounted in proximity with said soleplate; means for providing a temperature reference signal mounted in said housing; means coupled to said means for sensing a temperature and said means for proividing a temperature reference signal for controlling said electric current to said electric heater in response to said temperature reference signal and sensed temperature to maintain a preselected temperature on said soleplate; means for sensing an atitude and motion of said pressing iron; and timer means connected to said means for sensing said attitude and motion of said pressing iron, said timer means being enabled in response to said pressing iron assuming a first preselected attitude to provide a time attitude signal after a preselected period to said means for controlling electric current, said timer means providing a timed motion control signal to said means for controlling electric current in response to motion of said pressing iron ceasing while said pressing iron is in a second preselected attitude, said first preselected attitude being said upended position and said second attitude position being said horizontal use position, said means for controlling electric current being connected in series with said electric heater and said current supply means to inhibit flow of current to said electric heater upon receipt of either said first timed attitude signal or said second timed motion signal.

18. A pressing iron comprising: a metal soleplate adapted to be placed in contact with a fabric to be pressed; an electric heater monted in good thermal conducting relationship with said soleplate and having means for connecting it to an electric current from a source of electric current; a housing connected to said soleplate, said housing including a handle and a heel rest; means for sensing a temperature of said soleplate mounted in proximity with said soleplate; means for providing a temperature reference signal mounted in said housing of said pressing iron; means for comparing said sensed temperature of said soleplate with said temperature reference signal to produce a temperature error signal; means for controlling said electric current in response to said temperature error signal; means for sensing an attitude and motion of said pressing iron; and timer means connected to said means for sensing said attitude and motion of said pressing iron, said timer means being enabled in response to said pressing iron assuming a first preselected attitude to provide a timed attitude signal a preselected period to said means for controlling electric current, said iron having its soleplate upright and being supported on said heel rest when in said first preselected attitude, said timer means providing a timed motion control signal to said means for controlling electric current in response to motion of said pressing iron ceasing while said pressing iron is in a second preselected attitude, said iron having said soleplate in a horizontal position when in said second preselected attitude, said means for controlling electric current being connected in series with said electric heater and said current supply means to inhibit flow of current to said electric heater upon receipt of either said first timed attitude signal or said second timed motion signal.

19. A pressing iron comprising: a soleplate having a substantially U-shaped rib formed therein and having received in thermal contact therewith an electric heater, a steam passage located immediately contiguous with said electric heater rib and in good heat conducting relationship therewith, a thermistor well formed integral with an upper surface of said soleplate and extending from said upper surface to a position between said electric heater and said steam passageway in good heat transfer relation with said U-shaped rib and said steam passage and a thermistor seated within said thermistor well between said electric heater and said steam passageway and adapted to provide a temperature signal to other portions of said pressing iron indicative of temperature conditions prevailing immediately between said electric heater and said steam passage.

20. A pressing iron as defined in claim 19 wherein said thermistor is potted within a heat conductive material substantially filling said thermistor well in order to provide good heat transfer between said thermistor well and said thermistor.

21. A pressing iron as defined in claim 20 including a ceramic cap having a pair of lead apertures formed therein and positioned in said thermistor well and receiving a lead from said thermistor through each said lead aperture to electrically insulate said leads from said soleplate, said thermistor having a central cylindrical sensing portion located adjacent a bottom face of said ceramic cap and oriented parallel thereto.

22. A pressing iron comprising: a housing; a soleplate connected to said housing; an electric heating element mounted in good heat conducting relationship with said soleplate; means for controlling an electric current connected to said electric heating element and being adapted to receive an electric current from a suitable source of electric current and to selectively supply said electric current to said electric heating element; and first sensing means for responding to the orientation and motion of said soleplate connected to said means for controlling said electric current to supply said electric current to said heating element in response to detection of the horizontal orientation and motion by said first means indicative of iron use and to interrupt said electric current in response to detection of lack of the horizontal orientation and motion of said iron by said first means indicative of iron non-use; said first sensing means responsive to orientation and motion comprises a mercury switch having spaced contacts which are adapted to be closed by a pool of mercury, said contacts being so disposed in spaced relationship that with said soleplate disposed horizontally and motionless said pool of mercury closes said switch contacts, horizontal movement of said soleplate in the horizontal position causes movement of said pool of mercury opening and closing said contacts, said contacts and said pool of mercury being so disposed when said soleplate is in a substantially vertical position that said contacts are open.

23. A pressing iron as defined in claim 22 wherein said mercury switch comprises a closed cylinder of conductive material partially filled with mercury and a contact extending coaxially into said cylinder from one end and being insulated from the cylinder, said cylinder comprising another contact of said switch and being disposed with its axis extending from the forward end to the rear end parallel to said soleplate.

* * * * *

UNITED STATES PATENT AND TRADEMARK OFFICE

CERTIFICATE OF CORRECTION

PATENT NO. : 4,686,352

DATED : August 11, 1987

INVENTOR(S) : Thomas L. Nawrot, John Vancha, James C. Mysicka

It is certified that error appears in the above-identified patent and that said Letters Patent are hereby corrected as shown below:

Column 4, line 14, change "ennlarged" to --enlarged--

Column 12, line 7, change "apertur" to --aperture--
Column 14, line 1, change "indictaive" to --indicative--

Column 14, line 59, change "claim 4" to --claim 5--
Column 14, line 62, change "or" to --of--
Column 14, line 64, change "oe" to --one--
Column 14, line 65, change "saaid" to --said--
Column 15, line 14, change "defiend" to --defined--
Column 15, line 16, change "capactior" to --capacitor--
Column 15, line 22, change "or" to --of--
Column 15, line 38/39 change "response" to --responsive--
Column 15, line 53 change "spaed" to --spaced--
Column 16, line 16, after "positioned" insert --substantially-
Column 16, line 57, change "formin" to --forming--
Column 17, line 4, delete "for" (second occurrence)
Column 17, line 33, change "monted" to --mounted--
Column 17, line 51, insert before "a" the word --after--

Signed and Sealed this

Seventeenth Day of January, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. :B1 4,686,352

DATED :December 14, 1993

INVENTOR(S) :Nawrot, et al

It is certified that error appears in the above-indentified patent and that said Letters Patent is hereby corrected as shown below:

In the left-hand column of page 1 of the Reexamination Certificate, line 11, the issue date of April 27, 1984 should read --Aug. 11, 1987-- and on line 13, the filing date of Aug. 11, 1987 should read --Apr. 27, 1984--.

In the list of U.S. Patent Documents, the following patent should be included:

| | | |
|---|---|---|
| 2,320,682 | 6/1/43 | Trautman |

Signed and Sealed this

Twelfth Day of July, 1994

*Attest:*

Bruce Lehman

BRUCE LEHMAN

*Attesting Officer*

*Commissioner of Patents and Trademarks*

US004686352B1

REEXAMINATION CERTIFICATE (2147th)

United States Patent [19]

[11] B1 4,686,352

Nawrot et al.

[45] Certificate Issued Dec. 14, 1993

[54] ELECTRONIC PRESSING IRON

[75] Inventors: Thomas L. Nawrot, Glen Ellyn; John Vancha, Bolingbrook; James C. Mysicka, Berwyn, all of Ill.

[73] Assignee: Sunbeam Corporation, Downers Grove, Ill.

Reexamination Request:
No. 90/002,926, Dec. 22, 1992

Reexamination Certificate for:

| | |
|---|---|
| Patent No.: | **4,686,352** |
| Issued: | **Apr. 27, 1984** |
| Appl. No.: | **605,442** |
| Filed: | **Aug. 11, 1987** |

Certificate of Correction issued Jan. 17, 1989.

[51] Int. Cl.[5] ..... H05B 1/02; D06F 75/26; G08B 21/00

[52] U.S. Cl. ..... 219/250; 38/82; 38/88; 38/90; 200/61.52; 200/61.85; 219/251; 219/257; 219/492; 219/501; 219/505; 338/22 R; 340/635; 340/686

[58] Field of Search ..... 219/245-259, 219/492, 501, 504, 505; 200/61.52, 61.85; 38/77.1-77.9, 74, 75, 82, 88, 90-92; 340/635, 686

U.S. PATENT DOCUMENTS 852,537 5/1907 Barr .
1,231,056 6/1917 Palmer et al. .
(List continued on next page.)

FOREIGN PATENT DOCUMENTS 38221 7/1978 Australia .
45478 3/1979 Australia .
(List continued on next page.)

OTHER PUBLICATIONS

Popular Electronics, Aug. 1972, pp. 50-53, "Touch Plate Power Switch".
(List continued on next page.)

*Primary Examiner*—Anthony Bartis

[57] ABSTRACT

An electric pressing iron having a motion and attitude sensor including a mercury switch connected to a timer, and in conjunction therewith is adapted to disable the electric heater of the iron when the iron is oriented with the soleplate substantially horizontal and is not moving. The motion and attitude sensor and timer are also adapted to disable the electric heater when the iron is oriented with its soleplate vertical after the passage of a preselected period of time.

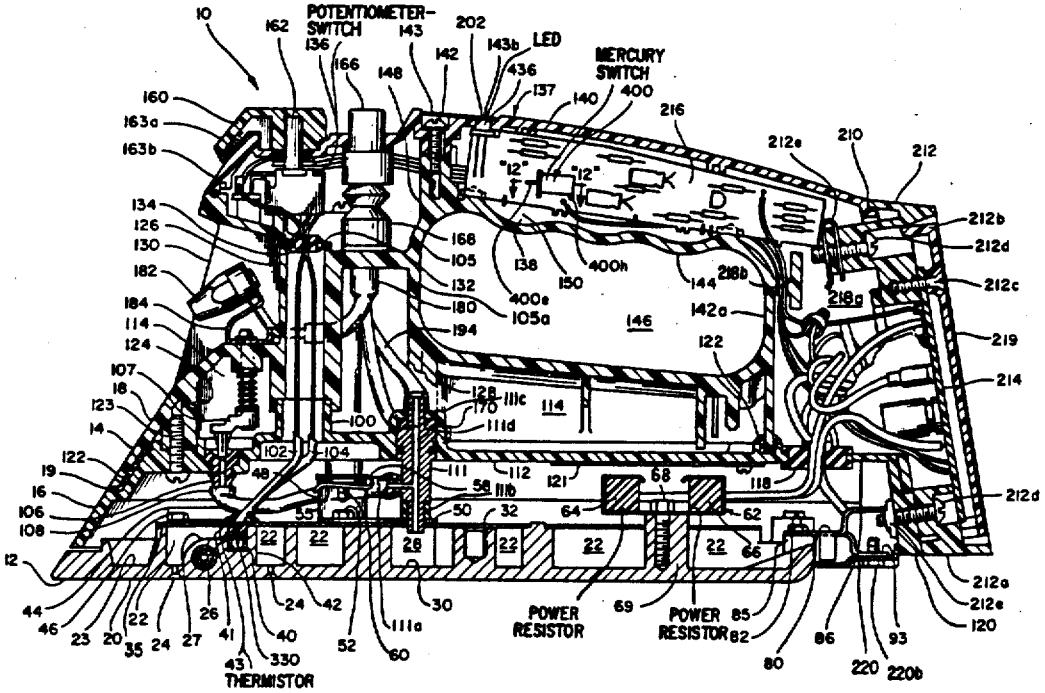

U.S. PATENT DOCUMENTS

| | | |
|---|---|---|
| 1,249,638 | 12/1917 | King . |
| 1,284,104 | 11/1918 | Heylman . |
| 1,350,933 | 8/1920 | Oca-Balda . |
| 1,365,186 | 1/1921 | Oca-Balda . |
| 1,430,830 | 10/1922 | Morgan . |
| 1,458,418 | 6/1923 | Johnston et al. . |
| 1,477,314 | 12/1923 | Colby . |
| 1,521,748 | 1/1925 | Brey . |
| 1,551,091 | 8/1925 | Dworkin . |
| 1,562,552 | 11/1925 | Hanley . |
| 1,573,801 | 2/1926 | Bown . |
| 1,683,252 | 9/1928 | Madigan . |
| 1,714,937 | 5/1929 | Anderson . |
| 1,981,309 | 11/1934 | Crossland et al. . |
| 2,150,029 | 3/1939 | French . |
| 2,290,869 | 7/1942 | Fingold . |
| 2,343,654 | 3/1944 | Finlayson . |
| 2,364,433 | 12/1944 | Finlayson . |
| 2,366,014 | 12/1944 | Finlayson . |
| 2,367,985 | 1/1945 | Weeks . |
| 2,382,587 | 8/1992 | Thomas . |
| 2,450,780 | 10/1948 | Bucklen, 3D . |
| 2,470,532 | 5/1949 | Thomas . |
| 2,782,308 | 2/1957 | Rug . |
| 2,796,994 | 6/1957 | Saltness . |
| 2,833,903 | 5/1958 | Waddell . |
| 2,848,659 | 8/1958 | Cutler . |
| 2,927,987 | 3/1960 | Uhl . |
| 3,067,364 | 12/1962 | Rosso . |
| 3,254,313 | 5/1966 | Atkins et al. . |
| 3,351,726 | 11/1967 | Cook . |
| 3,599,357 | 8/1971 | Gronwick et al. . |
| 3,641,410 | 2/1972 | Vogelsberg . |
| 3,651,391 | 3/1972 | Vogelsberg . |
| 3,703,217 | 11/1972 | Kulick et al. . |
| 3,798,462 | 3/1974 | Rizzo . |
| 3,827,040 | 7/1974 | Simmons . |
| 4,029,996 | 6/1977 | Miffitt . |
| 4,040,605 | 8/1977 | Townsend . |
| 4,104,618 | 8/1978 | Townsend . |
| 4,130,955 | 12/1978 | Baumgartner . |
| 4,203,101 | 5/1980 | Towsend . |
| 4,243,875 | 1/1981 | Chang . |
| 4,366,366 | 12/1982 | Ekblad . |
| 4,523,079 | 6/1985 | Albinger, Jr. . |

FOREIGN PATENT DOCUMENTS

| | | |
|---|---|---|
| 68825 | 3/1981 | Australia . |
| 541932 | 10/1981 | Australia . |
| 7834581 | 12/1981 | Australia . |
| 505338 | 7/1920 | France . |
| 372458 | 3/1923 | Germany . |
| 826179 | 12/1951 | Germany . |
| 1098116 | 1/1961 | Germany . |
| 3142619 | 5/1983 | Germany . |
| 8203520 | 10/1982 | PCT . |
| 9244 | 1/1907 | United Kingdom . |
| 15674 | 11/1909 | United Kingdom . |
| 180525 | 6/1922 | United Kingdom . |
| 203846 | 9/1923 | United Kingdom . |
| 211351 | 2/1924 | United Kingdom . |
| 215258 | 5/1924 | United Kingdom . |
| 216713 | 6/1924 | United Kingdom . |
| 251504 | 5/1926 | United Kingdom . |
| 316471 | 8/1929 | United Kingdom . |
| 317597 | 8/1929 | United Kingdom . |
| 340307 | 12/1930 | United Kingdom . |
| 370526 | 4/1932 | United Kingdom . |
| 386794 | 1/1933 | United Kingdom . |
| 434609 | 5/1935 | United Kingdom . |
| 445010 | 4/1936 | United Kingdom . |
| 467206 | 6/1937 | United Kingdom . |
| 470510 | 8/1937 | United Kingdom . |
| 471906 | 9/1937 | United Kingdom . |
| 594073 | 11/1947 | United Kingdom . |
| 1044428 | 9/1966 | United Kingdom . |
| 2009971 | 6/1979 | United Kingdom . |

OTHER PUBLICATIONS

Popular Science, Feb. 1973, pp. 124–125, "Touch Module".

Heathkit, Jr., "Electronic Workshop '135'", Heath Company, 1969, pp. 52–57 and 140–143.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-23 are confirmed.

* * * * *